US005847340A

United States Patent [19]

Godesa

[11] Patent Number: 5,847,340

[45] Date of Patent: Dec. 8, 1998

[54] POWER SWITCH MUTUALLY LOCKING ARRANGEMENT

[75] Inventor: Ludvik Godesa, Berlin, Germany

[73] Assignee: Siemens Aktiengesellschaft, München, Germany

[21] Appl. No.: 817,839

[22] PCT Filed: Oct. 30, 1995

[86] PCT No.: PCT/DE95/01520

§ 371 Date: Aug. 1, 1997

§ 102(e) Date: Aug. 1, 1997

[87] PCT Pub. No.: WO96/13842

PCT Pub. Date: May 9, 1996

[30] Foreign Application Priority Data

Oct. 31, 1994 [DE] Germany ..... 44 39 751.8

[51] Int. Cl.[6] ..... H01H 9/26

[52] U.S. Cl. ..... 200/50.32; 200/331; 218/154

[58] Field of Search ..... 200/50.21–50.27, 200/50.32–50.4, 400, 401, 331, 335, 336, 337, 338; 361/115; 218/154; 74/483 R

[56] References Cited

U.S. PATENT DOCUMENTS

| | | | |
|---|---|---|---|
| 3,651,709 | 3/1972 | Booty et al. | 74/483 R |
| 4,400,599 | 8/1983 | Rickmann | 200/50.36 |
| 4,620,077 | 10/1986 | Zdanys et al. | 200/331 |
| 4,626,638 | 12/1986 | Samples et al. | 200/331 |
| 4,703,137 | 10/1987 | Bohnen et al. | 200/50.25 |
| 4,788,453 | 11/1988 | Bohnen et al. | 307/119 |
| 4,968,861 | 11/1990 | Kuhn | 200/400 |

FOREIGN PATENT DOCUMENTS

| | | | |
|---|---|---|---|
| 2480993 | 10/1981 | France | H01H 9/26 |
| 3841315 | 6/1989 | France | H01H 9/26 |
| 36 11 020 | 10/1987 | Germany . | |
| 38 41 315 | 6/1989 | Germany . | |
| 31 14 186 | 8/1990 | Germany . | |
| 4002936 | 11/1991 | Germany | H01H 9/26 |
| 34 12 518 | 5/1993 | Germany . | |
| 4409172 | 9/1994 | Germany | H01H 9/26 |
| 43 33 828 | 3/1995 | Germany . | |
| 1199074 | 7/1970 | United Kingdom | H01H 9/26 |
| 96/13842 | 5/1996 | WIPO | H01H 9/26 |

*Primary Examiner*—J. R. Scott
*Attorney, Agent, or Firm*—Kenyon & Kenyon

[57] ABSTRACT

The arrangement for mutually locking the actuation of at least two power switches (A, B, C) has a position indicator (7) and an evaluation apparatus (10) for each power switch (A, B, C). A carrying plate (6) accommodating the position indicator (7) and the evaluation apparatus (10) is assigned to a side wall of the power switch (A, B, C). A shaft coupling (30) and a driver coupling (31) establish the connection with a switching shaft or a control shaft, respectively, of a device (32) that releases or locks the actuation of the power switch (A, B, C) when the carrying plate (6) is mounted on the power switch (A, B, C) or on a withdrawable rack (26).

6 Claims, 3 Drawing Sheets

POWER SWITCH MUTUALLY LOCKING ARRANGEMENT

BACKGROUND OF THE INVENTION

1. Field of the Invention

The present invention concerns an arrangement for mutually locking the actuation of at least two power switches. Each power switch has a side wall and a switching shaft accessible on the side wall, as well as a control shaft, which is also accessible on the side wall, of a device that releases or locks the actuation of the power switch. The invention includes a position indicator for emitting a mechanical signal corresponding to the switching position supplied via a transmission means (Bowden control), as well as an evaluation apparatus that can be controlled through the mechanical signals for actuating at least the control shaft of one of the power switches.

2. Description of the Prior Art

A locking arrangement was disclosed in German Patent 44 09 172 A1. The mechanical signals in this arrangement are transmitted by flexible, Bowden control-type transmission means. A rod assembly is also known to be used for this purpose (German Patent A 38 41 315). While rod assemblies require a fixed spatial arrangement in relation to the power switches, flexible transmission means allow power switches set up either side by side or one on top of the other to be linked.

In the safety device according to German Patent 44 09 172 A1, each power switch has an adapter block that forms a position indicator and a device for supplying a signal locking the actuation of the same power switch. This assumes a close physical proximity of the switching shaft and the control shaft, or the adapter block becomes too large and unwieldy. The evaluation apparatus is used to provide only certain combinations of switching states in a system of three power switches. The evaluation apparatus is always supplied with a mechanical signal of both the position indicator and the power switch on which the evaluation apparatus is mounted, as well as with another signal provided by the position indicator of one of the other power switches. The output signal of the evaluation apparatus is supplied to the remaining power switch as a locking signal. Thus, when designing the safety device, it must always be checked whether the desired combination of allowable switching states requires the use of an evaluation apparatus or whether the desired dependence can be achieved through the adapter blocks alone.

A device releasing or locking the actuation of a power switch, which can also be referred to as a switch-on locking mechanism, is described in German Patent 43 33 828 C1, published after the priority date of the present application. The possibility of using the switching position of another power switch as a control signal is indicated in this patent.

SUMMARY OF THE INVENTION

The object of the present invention is to make the use of a safety device independent of the distance between the switching shaft and the control shaft and to allow the user to achieve any desired allowable combination of switching states using basically the same hardware.

This object is achieved according to the present invention by assigning an evaluation apparatus to each power switch and arranging the evaluation apparatus together with the position indicator of the respective power switch on a common carrying plate arranged in parallel to the side wall, and by each evaluation apparatus having at least one input slide with an output slide that can be coupled to the control shaft of the corresponding power switch.

A uniform hardware configuration that is independent of the intended safety function is created by each power switch having a position indicator and an evaluation apparatus. In addition, this hardware is also independent of the type of arrangement of the power switches, since the carrying plate allows both fixed and movable or withdrawable power switches to be functionally connected. The design of the position indicator as a pure position indicator, which works together with the switching shaft, but not with the control shaft, is an important feature for the device of the present invention. Thus the distance between the switching shaft and the control shaft has no influence on the design of the position indicator. Only the evaluation apparatus has the function of working together with the control shaft. The function of direct coupling between the at least one input slide and the output slide or, in the embodiment with two input slides, the desired function as an AND or element is achieved through simple configuration or setting of the evaluation apparatus by the user.

The arrangement according to the present invention fundamentally differs from another known locking device according to German Patent 31 14 186 C2, suited for switching devices of different sizes and located at different distances from one another, because of the above-mentioned properties. This related prior art provides a locking enclosure, arranged at any desired location, to be connected to the switching devices through flexible transmission means. Depending on the desired logical function, different locking enclosures are used. The position indicators are separate modules to be mounted on the switching devices.

A connection between the switching shaft of the power switch and an actuating shaft of the position indicator can be established according to the present invention using a shaft coupling, and a connection between the evaluation apparatus and the control element can be established using a driver coupling. Retrofitting the power switch with a position indicator is facilitated for the user by the shaft coupling and the driver coupling.

This arrangement is equally well suited for a non-detachable installation or for a withdrawable arrangement of a power switch. It is recommended that the carrying plate of a power switch designed for permanent installation be permanently connected to the power switch. On the other hand, a power switch movably installed on a withdrawable rack can be attached to the withdrawable rack with the shaft coupling and the driver coupling being detachable in the direction of travel of the power switch.

The use of a uniform carrying plate for different power switch designs can be made possible by the side wall of the power switch assigned to the carrying plate having means for accommodating fasteners to secure an adapter plate serving as a support for the carrying plate. Such an adapter plate can also be used if power switches are not mounted in a switching cabinet or a multispan switchgear, but on a single wall using suitable brackets. In this case, it is recommended that the bracket has openings aligned with at least part of the accommodating means provided for attaching the adapter plate.

BRIEF DESCRIPTION OF THE DRAWINGS

The invention is now explained in detail using the embodiments illustrated in the drawings.

FIG. 1 *a* is an electrical schematic of the switches of FIG. 1.

DETAILED DESCRIPTION OF THE INVENTION

Figures 1, 1A:
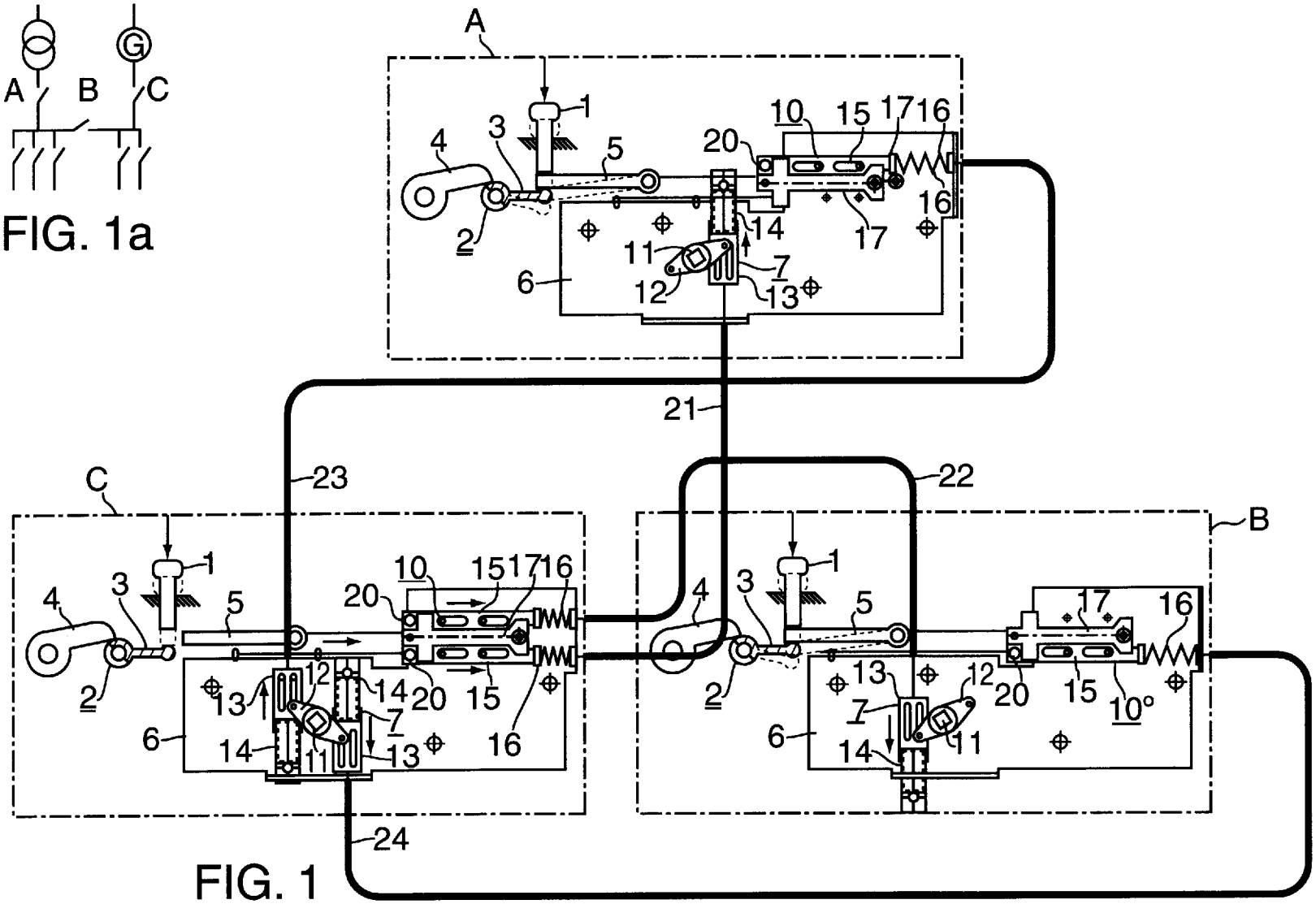
FIG. 1 schematically shows an arrangement for interlocking three power switches.

In FIG. 1, three low-voltage power switches A, B, and C are enclosed in dot-and-dash lines. The wiring diagram in the upper left part of FIG. 1*a* shows the functional relationship between power switches A, B, and C, according to which power switch A is the supply switch for a transformer and power switch C is the supply switch for a generator. Power switch B forms a longitudinal coupling of the sections of a bus to which power switches A and C are connected. The function of the locking arrangement consists of preventing power switch C from switching on when power switches A and B are switched on. Conversely, power switches A and B should be locked when power switch C is switched on.

A detailed description of the apparatus shown in FIGS. 1 and 1*a* is given in my copending U.S. patent application entitled DEVICE FOR MUTUALLY LOCKING THE ACTUATION OF AT LEAST TWO POWER SWITCHES, U.S. patent application Ser. No. 08/817,838.

Each of power switches A, B, and C has an ON pushbutton 1 for actuating a switching-on semishaft 2 using an extension 3 mounted on the semishaft. A switching-on latch 4 is supported by switching-on semishaft 2. In a known manner, the clockwise rotation of switching-on semishaft 2 causes switching-on latch 4 to be released and thus the switching contacts of the respective power switch to close.

The switching-on semishaft can be actuated using the ON pushbutton only if a locking slide 5 is between ON pushbutton 1 and extension 3 of switching-on semishaft 2, as shown in FIG. 1 for power switches A and B. If locking slide 5 is drawn back as in power switch B, pressing ON pushbutton 1 is ineffective. Thus the respective power switch cannot be switched on. This device, which can also be called a switching-on locking mechanism, is described in more detail in German Patent Application P 43 33 828.3.

A detailed description of the above-described mechanism is given in the application entitled EVALUATION APPARATUS FOR A POWER SWITCH MUTUALLY LOCKING SYSTEM, based on PCT/DE95/01518 and U.S. patent application Ser. No. 08/817,985.

A carrying plate 6 with a position indicator 7 and an evaluation apparatus 10 mounted on it is assigned to each power switch A, B, and C. The function of position indicator 7 is to produce a mechanical signal that depends on the switching position of the respective power switch. For this purpose, position indicator 7 has an actuating shaft 11, which is coupled with a switching shaft of the power switch in a manner to be described later. A two-armed lever 12, articulatedly connected with one or two movably guided slides 13, is mounted on actuating shaft 11. When the respective power switch A, B, or C is switched on, a Bowden control connected to one of evaluation apparatuses 10 is actuated through a spring accumulator 14. Position indicator 7 for power switch C has two slides 13 and two spring accumulators 14 to generate two signals. Prior to describing the connection of position indicators 7 and evaluation apparatuses 10, the operation of the evaluation apparatuses. Each evaluation apparatus 10 has one or two input slides 15, which are held in the rest position by a restoring spring 16. Evaluation apparatuses, each with an input slide, are assigned to power switches A and B, while power switch C has an evaluation apparatus 10 with two input slides 15. Furthermore, each evaluation apparatus 10 has an output slide 17, which can be coupled with input slide 15 through coupling member 20 installed in input slide 15. Depending on whether the respective evaluation apparatus 10 should operate as a single-channel or dual-channel AND element or an OR element, coupling members 20 can be used or omitted. In the example of FIG. 1, all evaluation apparatuses 10 are equipped with coupling members 20. The above-mentioned locking slides 5 are directly connected to output slide 17.

To achieve the above-mentioned desired dependence between power switches A, B, and C, a total of four Bowden controls are provided as flexible transmissions. In particular, Bowden control 21 connects position indicator 7 of power switch A with the first input slide 15 of evaluation apparatus 10 of power switch C. Another Bowden control 22 connects position indicator 7 of power switch B with another input slide 15 of position indicator 10 of power switch C. Position indicator 7 of power switch C has two outputs, one of which is connected to evaluation apparatus 10 of power switch A through a Bowden control 23 and the other one is connected to evaluation apparatus 10 of power switch B through a Bowden control 24.

FIG. 1 shows the condition where power switches A and B are on and power switch C is locked against being switched on. This condition is created by the fact that, due to the ON position of power switches A and B through the respective position indicators 7, Bowden controls 21 and 22 are actuated and therefore input slides 15 of evaluation apparatus 10 of power switch C are moved to the right, together with output slide 17. Therefore locking slide 5 is also moved to the right, causing ON pushbutton 1 to execute a no-load stroke when depressed, without actuating switching-on semishaft 2.

Figure 2:
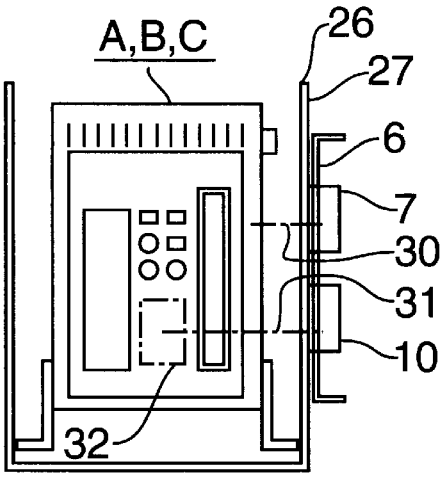
FIGS. 2, 3, and 4 show different ways of mounting a carrying plate on which a position indicator and an evaluation apparatus are mounted.
Figure 3:
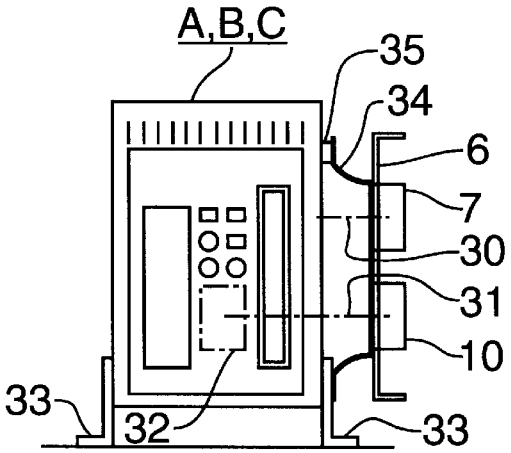
Figure 4:
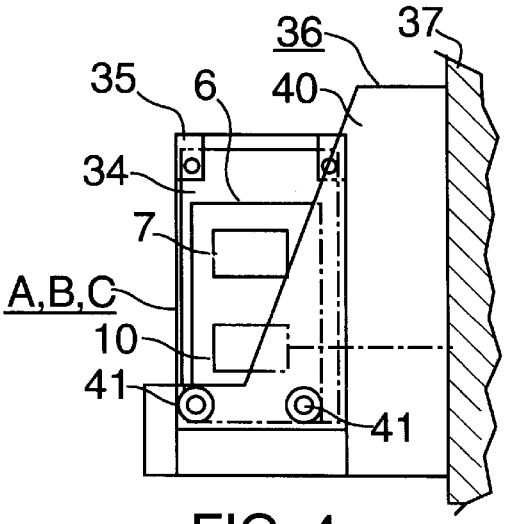

Carrying plate 6 can be mounted in different ways according to the manner in which the power switch is installed. This is schematically shown in FIGS. 2, 3, and 4. In FIG. 2 one of power switches A, B, or C is movably mounted in withdrawable rack 26. Carrying plate 6 is attached to the right-hand side wall 27 of withdrawable rack 26. A shaft coupling 30 connects an internal switching shaft of power switch A, B, or C to actuating shaft 11 of position indicator 7. A driver coupling 31 connects output slide 17 of evaluation apparatus 10 with a device 32, indicated by a dot-and-dash line, with the function of locking slide 5, which engages between ON pushbutton 1 and extension 3, as shown in FIG. 1.

In another example, according to FIG. 3, power switch A, B, or C is permanently mounted in a switching cell of a switchgear using brackets 33. An adapter plate 34, non-detachably connected to power switch A, B, or C, serves as a support for carrying plate 6. In the example shown, support projections 35 on the enclosure of power switch A, B, or C and, for example, tapped holes or the like in the brackets 33 serve for accommodating the fastening hardware.

The same adapter plate 34 can also be used if power switch A, B, or C is attached to a wall 37 using two brackets 36. In this case at least one side wall 40 of bracket 36 has an outline allowing adapter plate 34 and then carrying plate 6 to be mounted without previously removing power switch A, B, or C from brackets 36. Openings 41 in side wall 40 allow the fastening screws of adapter plate 34 and carrying plate 6 to be handled.

Figure 5:
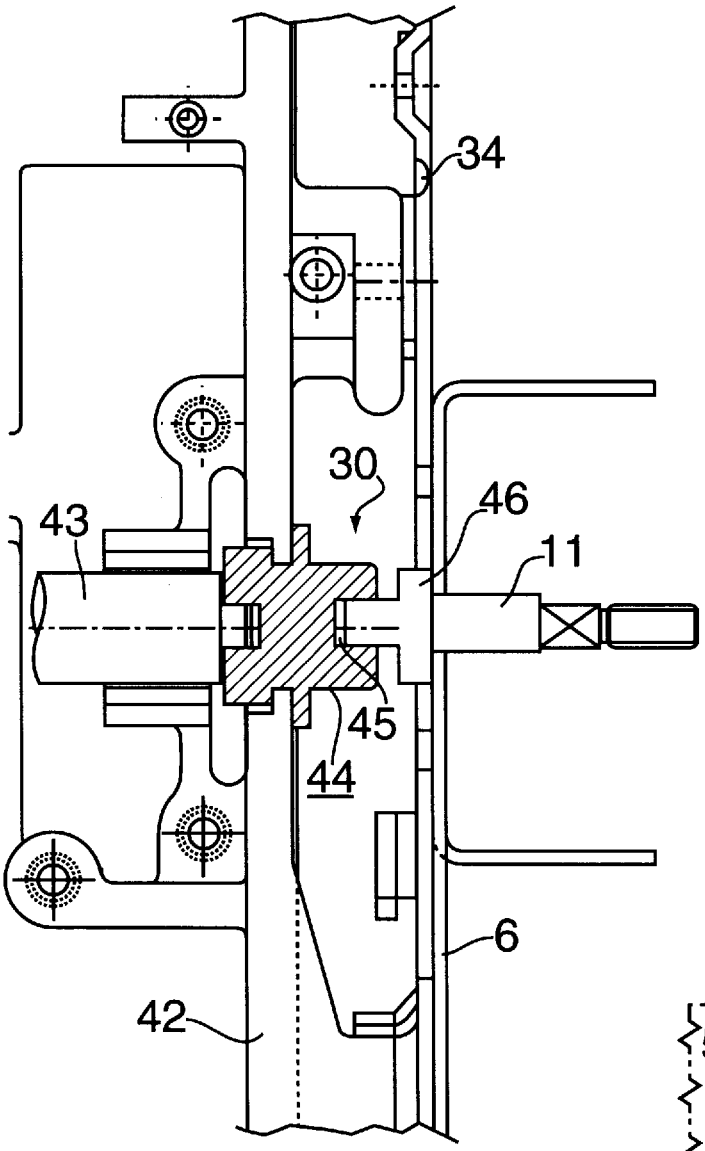
FIG. 5 shows the longitudinal section of a shaft coupling.

An example of the embodiment of shaft coupling 30 is shown in FIG. 5, where part of a side wall 42 of a power switch A, B, or C is shown to which adapter plate 34 is attached. Carrying plate 6 with actuating shaft 11 for position indicator 7 (not shown in FIG. 5) are on adapter plate 34. A switching shaft 43 of the power switch does not extend through side wall 42, but ends within the housing and is provided with an electrically insulating coupler 44, which is rotatably mounted in side wall 42. In this way electric shock protection is preserved despite actuating shaft 11 being coupled externally. Coupler 44 has a coupling slot 45, into which a suitably shaped end piece 46 of the actuating shaft can be introduced. In this way, a connection between switching shaft 43 and actuating shaft 11 can be established either by sliding or by inserting.

Figure 6:
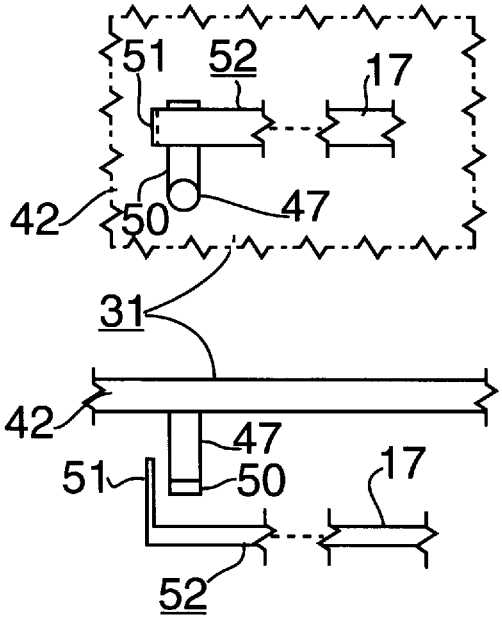
FIG. 6 shows a driver coupling.

FIG. 6 shows an example of a driver coupling 31 between an evaluation apparatus 10 and device 32. A control shaft 47 having an actuating arm 50 extends through side wall 42 (partially shown) of a power switch. A bent portion 51 of a guide slide 52, which can be connected to output slide 17 of evaluation apparatus 10 or manufactured as a single piece with the same, is opposite actuating arm 50. Thus also driver coupling 31 becomes engaged when carrying plate 6 is mounted on a power switch. For locating the carrying plate, it is essential that the same distance from the side wall of the power switch be observed for all types of power switch installation. For example, the distance between the power switch and the side wall provided for mounting the carrying plate can be selected as a reference distance. The adapter plate is configured so that the same position is obtained for the carrying plate or the power switch side wall.

What is claimed is:

1. A mutually locking device comprising:

at least two power switches, each power switch including a side wall and a switching shaft, each switching shaft being accessible on one of the side walls, each power switch including a control element accessible on one of the side walls, each power switch including a device that releases and locks the actuation of one of the power switches, each device that releases and locks the actuation of one of the power switches being accessible on one of the side walls, each power switch including a position indicator producing a mechanical signal corresponding to a switching position, each power switch including an evaluation apparatus controlled by one of the mechanical signals, each evaluation apparatus operating one of the control elements, each power switch including a common carrying plate, the evaluation apparatus and the position indicator of each power switch being arranged on one of the common carrying plates, each common carrying plate being arranged parallel to one of the side walls, each evaluation apparatus including at least one input slide and at least one output slide that is coupled to the control element of the respective power switch in one position of the input and output slides and uncoupled from the control element of the respective power switch in another position of the input and output slides; and a plurality of mechanical transmission members connected to at least one of the evaluation devices and at least one of the position indicators, the mechanical transmission members transmitting the mechanical signals, the evaluation apparatuses being controlled by the mechanical signals to actuate at least the control element of one of the power switches.

2. The device according to claim 1, wherein:

each position indicator includes an actuating shaft, a shaft coupling and a driver coupling, and wherein a connection is established between the switching shaft of one of the power switches and the actuating shaft of one of the position indicators using the shaft coupling, and wherein a connection is established between one of the evaluation apparatuses and one of the control elements using the driver coupling.

3. The device according to claim 2, wherein:

each carrying plate is permanently connected to the respective power switch.

4. The device according to claim 2, further comprising:

a withdrawable rack, and wherein at least one of the power switches is movably arranged in the withdrawable rack, the carrying plate being attached to the withdrawable rack, and wherein the shaft coupling and driver coupling are detachably connected in a direction of travel of the respective power switch to the switching shaft of one of the power switches and the actuating shaft of one of the position indicators, and to one of the evaluation apparatuses and one of the control elements, respectively.

5. The device according to claim 1, wherein:

each side wall includes at least one opening accommodating fastening hardware for an adapter plate which is designed as a support for the carrying plate.

6. The device according to claim 5, further comprising:

a bracket for attaching one of the power switches to a wall, the bracket including openings aligned with at least a part of the at least one opening accommodating fastening hardware.

* * * * *